US007849836B2

(12) United States Patent
Chang

(10) Patent No.: US 7,849,836 B2
(45) Date of Patent: Dec. 14, 2010

(54) COOLING FEATURE FOR FUEL INJECTOR AND FUEL SYSTEM USING SAME

(75) Inventor: David Chang, Edwards, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 12/287,248

(22) Filed: Oct. 7, 2008

(65) Prior Publication Data

US 2010/0084489 A1 Apr. 8, 2010

(51) Int. Cl.
*F02M 53/04* (2006.01)

(52) U.S. Cl. ..... 123/456; 239/132; 239/132.1; 239/132.3; 239/132.5

(58) Field of Classification Search ..... 239/131.1, 239/131.3, 131.5, 124, 128, 131, 132, 132.1, 239/132.3, 132.5; 123/456
See application file for complete search history.

(56) References Cited

U.S. PATENT DOCUMENTS 4,312,316 A 1/1982 Seilly et al.
4,420,116 A * 12/1983 Warlick ..... 239/95
4,553,059 A 11/1985 Abe et al.
5,076,236 A * 12/1991 Yu et al. ..... 123/467
5,168,855 A * 12/1992 Stone ..... 123/446
5,191,867 A * 3/1993 Glassey ..... 123/446
5,217,085 A 6/1993 Barrie et al.
5,299,738 A * 4/1994 Genter et al. ..... 239/91
5,445,323 A * 8/1995 Perr et al. ..... 239/91
5,524,825 A 6/1996 Ueda
5,820,033 A * 10/1998 Cooke ..... 239/585.5
5,915,626 A 6/1999 Awarzamani et al.
6,085,727 A * 7/2000 Nakano ..... 123/447
6,167,869 B1 1/2001 Martin et al.
6,168,091 B1 * 1/2001 Rodier et al. ..... 239/88
6,279,842 B1 * 8/2001 Spain ..... 239/585.1
6,323,613 B1 11/2001 Hara et al.
6,354,271 B1 * 3/2002 Satapathy ..... 123/446
6,749,129 B2 * 6/2004 Hefler et al. ..... 239/88
6,833,641 B2 12/2004 Uchida et al.
7,021,558 B2 * 4/2006 Chenanda et al. ..... 239/125
7,088,209 B2 8/2006 Keck
7,090,145 B2 * 8/2006 Baker et al. ..... 239/132.5
7,383,794 B2 * 6/2008 Hlousek et al. ..... 123/41.33
2002/0046738 A1 4/2002 Kreutziger
2002/0088958 A1 7/2002 Weldon
2003/0085308 A1 5/2003 Parrish
2004/0007210 A1 * 1/2004 Tian et al. ..... 123/456

(Continued)

FOREIGN PATENT DOCUMENTS

JP 06053760 7/1994

(Continued)

*Primary Examiner*—Stephen K Cronin
*Assistant Examiner*—David Hamaoui
(74) *Attorney, Agent, or Firm*—Liell & McNeil

(57) ABSTRACT

A thermal load control assembly for a fuel injector includes a rail inlet port, a cooling inlet port and a fuel drain port. A leakage path channels leaked fuel originating from the rail inlet port to the fuel drain port. A cooling path channels fuel originating from the cooling inlet port to the fuel drain port. A fuel system using a thermal load control assembly includes a single fuel tank that supplies fuel to the rail inlet port and the cooling inlet port of a plurality of fuel injectors and collect fuel from the fuel drain port of the plurality of fuel injectors.

17 Claims, 3 Drawing Sheets

U.S. PATENT DOCUMENTS

2006/0213467 A1 9/2006 Froeschle et al.
2007/0256667 A1 11/2007 Xi et al.
2008/0017169 A1 1/2008 Hlousek et al.
2008/0295806 A1* 12/2008 Chang et al. ..... 123/470
2010/0077971 A1* 4/2010 Venkataraghavan et al. ..... 123/41.42
2010/0176223 A1* 7/2010 Venkataraghavan et al. ..... 239/585.1

FOREIGN PATENT DOCUMENTS

JP 08200183 8/1996

* cited by examiner

COOLING FEATURE FOR FUEL INJECTOR AND FUEL SYSTEM USING SAME

TECHNICAL FIELD

The present disclosure relates generally to fuel injectors, and in particular to fuel injectors with a cooling feature.

BACKGROUND

Common rail fuel systems are one of several diesel engine fuel systems used to improve diesel engine emissions and performance. Common rail fuel systems include a common rail supplying fuel to a plurality of fuel injectors. At least a part of these fuel injectors are maintained at rail pressure, while another part of the fuel injectors are kept at low pressures. The pressure differential between the various parts of the fuel injectors can create potential leakage paths.

Leakage paths allow fuel to travel from high-pressure regions to low pressure regions. Any leakage of fuel that occurs at these higher fuel pressures tends to generate heat in the vicinity of the leakage path and the heat is transferred to the injector components.

In addition to the increased pressures inside fuel injectors, diesel engine manufacturers have been utilizing multiple injections of fuel into the combustion chamber during any particular combustion phase to meet the increasingly stringent emissions regulations. In most cases, multiple injections are achieved by electrically energizing an actuator (e.g., solenoids, piezo-electric actuators, etc.) that controls the movement of a valve multiple times during each combustion cycle. To accomplish these multiple actuation events, more electrical energy is required. However, the increase in electrical energy supplied to the actuator often results in an increase in the heat energy that is generated. This is especially problematic in connection with the use of solenoids, which tend to be susceptible to uncertain or degraded behavior at temperatures that can be easily reached if the fuel injector is not sufficiently cooled.

It has been known in the prior art that external cooling liquids may be used to cool overheated engine components. U.S. Pat. No. 4,553,059 (known as the '059 patent) provides insight for cooling a piezoelectric actuator that may be degraded when the temperature of the piezoelectric element becomes higher than a Curie point. In the '059 patent, the piezoelectric element experienced an increase in temperature through the repeated energization of the piezoelectric elements during injection events. The '059 patent teaches the use of an external cooling liquid to cool the piezoelectric actuator by allowing the liquid to flow around the actuator.

The present disclosure is directed to overcoming one or more of the problems set forth above.

SUMMARY

In one aspect, a fuel injector comprises an injector body that defines a nozzle outlet, a common rail inlet port, a cooling inlet port and a fuel drain port. A leakage path fluidly connects the common rail inlet port to the fuel drain port. A cooling path fluidly connects the cooling inlet port to the fuel drain port.

In another aspect, a common rail fuel system comprises a plurality of fuel injectors. Each of the plurality of fuel injectors includes a common rail inlet port and a cooling inlet port. A common rail is fluidly connected to the common rail inlet port. A cooling line is fluidly connected to the cooling inlet port. The common rail fuel system also includes a fuel tank for supplying fuel to the common rail and the cooling line.

In yet another aspect, a method of operating a fuel system includes the steps of moving relatively small amount of fuel through a nozzle outlet of a fuel injector during a first injection event and a second injection event. The method also includes a step of moving a relatively large amount of fuel through a drain port of the fuel injector between the first injection event and the second injection event. The method also includes moving leakage fuel through the fuel drain port between the first injection event and the second injection event.

DETAILED DESCRIPTION

The present disclosure relates to a cooling feature used in fuel injectors and fuel systems. Common rail fuel injectors include portions that are maintained under high pressures as well as other portions that are kept under low pressures. The pressure differential between the high-pressure and low-pressure portions allows for the fuel to leak from high-pressure regions to low-pressure regions. Any leakage of fuel that occurs at these higher fuel pressures tends to generate heat and the heat is transferred to the injector components. As the pressures in fuel injectors continue to increase beyond 170 MPa and soon after, beyond 200 MPa, substantially more heat is generated, which may adversely affect the performance of fuel injectors and their components. The present disclosure discusses a cooling feature that may be used in a wide variety of fuel injectors and fuel systems experiencing excess heat generation and/or insufficient heat rejection.

Figure 1:
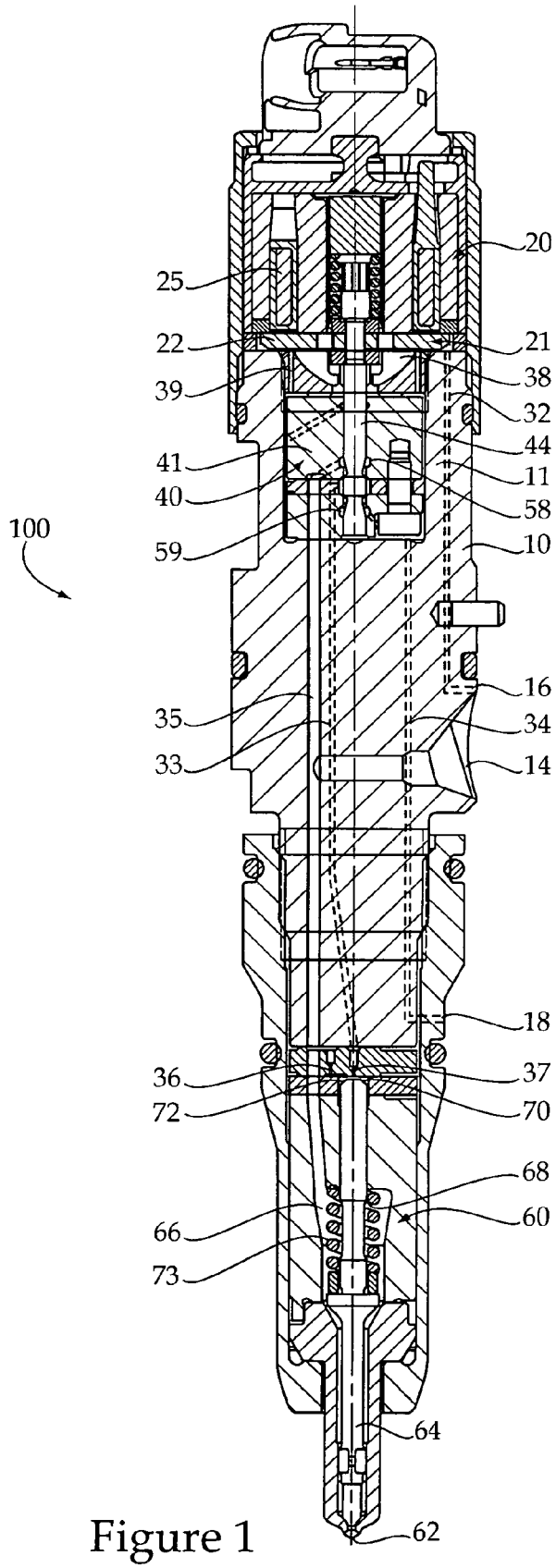
FIG. 1 is a sectioned front view of a fuel injector according to the present disclosure.

Referring to the drawings, FIG. 1 shows a fuel injector 100, which includes an injector body 11 that defines a nozzle outlet 62, a common rail inlet port 14, a cooling inlet port 16 and a fuel drain port 18. The injector body 11 further includes a nozzle assembly 60, a control valve assembly 40 and a solenoid assembly 20 that includes an armature assembly 21 and a solenoid coil 25.

In the present disclosure, the nozzle assembly 60 includes a nozzle chamber 66, a needle control chamber 72 and a direct controlled nozzle valve 64 biased by a nozzle spring 73. The nozzle valve 64 is movable between a first position that closes the nozzle outlet 62 and a second position that opens the nozzle outlet 62. The nozzle valve 64 includes an opening hydraulic surface 68 exposed to fuel pressure inside the nozzle chamber 66. The nozzle chamber 66 may receive high-pressure fuel entering through the common rail inlet port 14 via a rail supply passage 35. In the present disclosure, high-pressure fuel is coming from a common rail and thereby the pressure inside the nozzle chamber 66 is maintained at rail pressure. The nozzle valve 64 also has a closing hydraulic surface 70 exposed to fuel pressure inside the needle control chamber 72.

Figure 2:
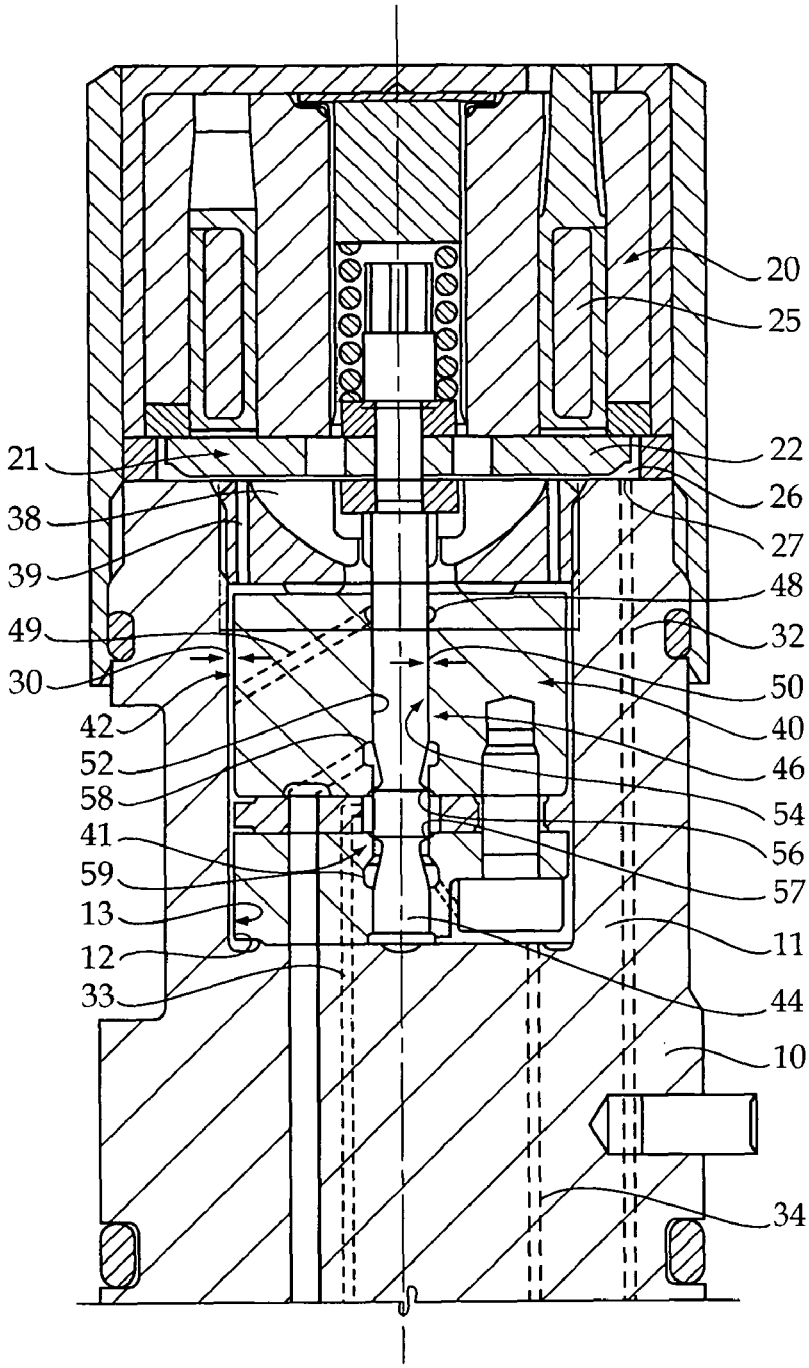
FIG. 2 is an enlarged sectioned front view of a control valve of the fuel injector shown in FIG. 1.

Referring in addition to FIG. 2, the control valve assembly 40 includes a control valve member 44 that moves between an upper valve seat 56 and lower valve seat 57. A first annular opening 58 is located above the upper valve seat 56 and a second annular opening 59 is located below the lower valve seat 57. The rail supply passage 35 extends between the nozzle chamber 66 and the first annular opening 58 of the control valve assembly 40. A first flow restrictor 36 extends between the rail supply passage 35 and the needle control chamber 72. A valve supply passage 33 extends from the area between the upper valve seat 56 and the lower valve seat 57 to a second flow restrictor 37, which is fluidly connected to the needle control chamber 72. The second flow restrictor 37 has a larger flow area than the first flow restrictor 36. A fuel drain passageway 34 extends between the drain port 18 and the second annular opening 59. In FIGS. 1 and 2, the dotted lines representing the fuel drain passage 34 may appear disconnected because of the sectional view shown. However, the fuel drain passage 34 fluidly connects the second annular opening 59 to the drain port 18.

The control valve assembly 40 includes the control valve member 44 and a valve guide 52 disposed inside a control valve 41. The control valve member 44 has an outer surface 46 and the valve guide 52 has an inner surface 54. There is a guide clearance 50 (shown greatly exaggerated) between the outer surface 46 of the control valve member 44 and the inner surface 54 of the valve guide 52, which allows the control valve member 44 to travel within the valve guide 52 without excessive wear. However, those skilled in the art may appreciate that there is a narrow guide clearance 50 between the inner surface 54 of the guide piece 52 and the outer surface 46 of the control valve member 44, and that the guide clearance 50 runs along the length of the control valve member 44.

The injector body 10 defines a hollow cavity 12 inside which the control valve assembly 40 is positioned. The injector body 10 has a casing 11, which has an internal surface 13 that encloses the control valve assembly 40. Further, the control valve 41 has an external surface 42 that is adjacent the internal surface 13 of the injector body casing 11. There is a cooling clearance 30 separating the external surface 42 of the control valve 41 and the internal surface 13 of the injector body casing 11. Those skilled in the art will appreciate the cooling clearance 30 to extend throughout the length of the control valve 41 and throughout the distance between the internal surface 13 of the injector body casing 11 and the external surface 42 of the control valve 41.

At some point along the valve guide 52, the valve guide 52 may define a weep annulus 48. The weep annulus 48 accumulates the fuel that leaks up along the guide clearance 50. A weep annulus passage 49 may allow fuel to flow from the weep annulus 48 to the cooling clearance 30. The weep annulus passage 49 may be a bore drilled inside the control valve 41 or may be an internal passage made from ordinary machining methods. Those skilled in the art may appreciate that the location of the weep annulus 48 may affect the amount of heat transfer between the fuel and the solenoid coil 25 inside the armature assembly 21. As the leakage fuel gets closer to the solenoid coil 25, the greater heat transfer there may be between the coil 25 and the surrounding fuel. Therefore, those skilled in the art may select a position on the valve guide 52, which is far enough from the armature assembly 21 to inhibit the leaked fuel from entering into the armature assembly 21. Also, the location at which the weep annulus passage 49 joins the cooling clearance 30 may vary. In one embodiment, fuel that leaks out of the guide clearance 50 into the weep annulus passage 49 may join the cooling clearance 30 as close as possible to the fuel drain port 18. The fuel that leaks out of the guide clearance 50 into the weep annulus passage 49 is defined as the leakage fuel. In one embodiment, the leakage fuel also includes any fuel that enters the fuel injector through the common rail inlet port 14 and leaves the fuel injector through the fuel drain port 18.

The injector body 10 also includes the armature assembly 21, which further includes an armature 22 disposed in an armature cavity 26. The armature cavity 26 has a cooling inlet opening 27 through which fuel enters the armature assembly 21. The cooling inlet opening 27 is connected to the cooling inlet port 16 via a cooling supply passage 32. It may be appreciated by those skilled in the art that the cooling inlet port 16 may be located at various locations inside the fuel injector 100. The cooling supply passage 32 may be a bore drilled inside the injector body 10 and may have a diameter sized to allow fuel to flow into the fuel injector 100 at varying desired flow rates.

A load screw 38 may be located inside the injector body 10 and may secure components of the fuel injector 100 to the injector body 10 while containing the pressure inside the injector body 10. The load screw 38 may include at least one load screw bore 39 passing through it, allowing fuel to travel between the different portions of the injector 100, including fuel from the armature cavity 26 to the cooling clearance 30.

Referring still to FIGS. 1 and 2, the fuel injector 100 also includes the fuel drain port 18. The fuel drain port 18 is fluidly connected to a fuel drain passage 34, allowing fuel to flow from inside the fuel injector 100 to the fuel drain port 18. Because the fuel drain port 18 and the fuel drain passage 34 are at low pressure, high pressure fuel that leaks from the valve guide 52 and fuel that enters from the cooling inlet port 16 will travel towards the fuel drain port 18. For the sake of simplicity, cooling fuel is defined to mean any fuel that enters into the fuel injector 100 through the cooling inlet port 16 and leaves the fuel drain port 18, and leakage fuel is the fuel that leaks out of the guide clearance 50 into the weep annulus passage 49. However, those skilled in the art will appreciate that during the multiple cycles of operation, the cooling fuel and the leakage fuel may mix inside the fuel injector 100 and therefore, the cooling fuel and leakage fuel may not be discernable during the actual operation of the fuel injector 100.

A leakage path is defined as the flow path of the leakage fuel beginning at the point it enters the common rail inlet port 14 and leaves the fuel injector 100 through the fuel drain port 18. The leakage path includes the area defined by the guide clearance 50 and the area defined by the weep annulus 48 and the weep annulus passage 49. Similarly, the flow path of the cooling fuel defines a cooling path. The cooling path is the flow path of the fuel entering in from the cooling inlet port 16 and leaving the fuel injector 100 through the fuel drain port 18. The cooling path also includes the load screw passage 39, the cooling clearance 30, the armature cavity 26 and the area inside the solenoid assembly 20. In one embodiment, the leakage fuel merges with the cooling fuel before exiting the fuel drain port 18.

Those skilled in the art may recognize that the present disclosure may be implemented in numerous possible ways. For instance, instead of having one cooling inlet port 16, a fuel injector 100 may have more than one cooling inlet port 16 that enters at various locations within the injector body 10. Similarly, a fuel injector 100 may have more than one fuel drain port 18 and the drain ports may be located at different locations within the injector body 10 as well. However, the present disclosure is not intended to limit the scope of the disclosure to the embodiments discussed herein. Instead, the present disclosure intends to include all embodiments that fall within the spirit of the disclosure.

Figure 3:
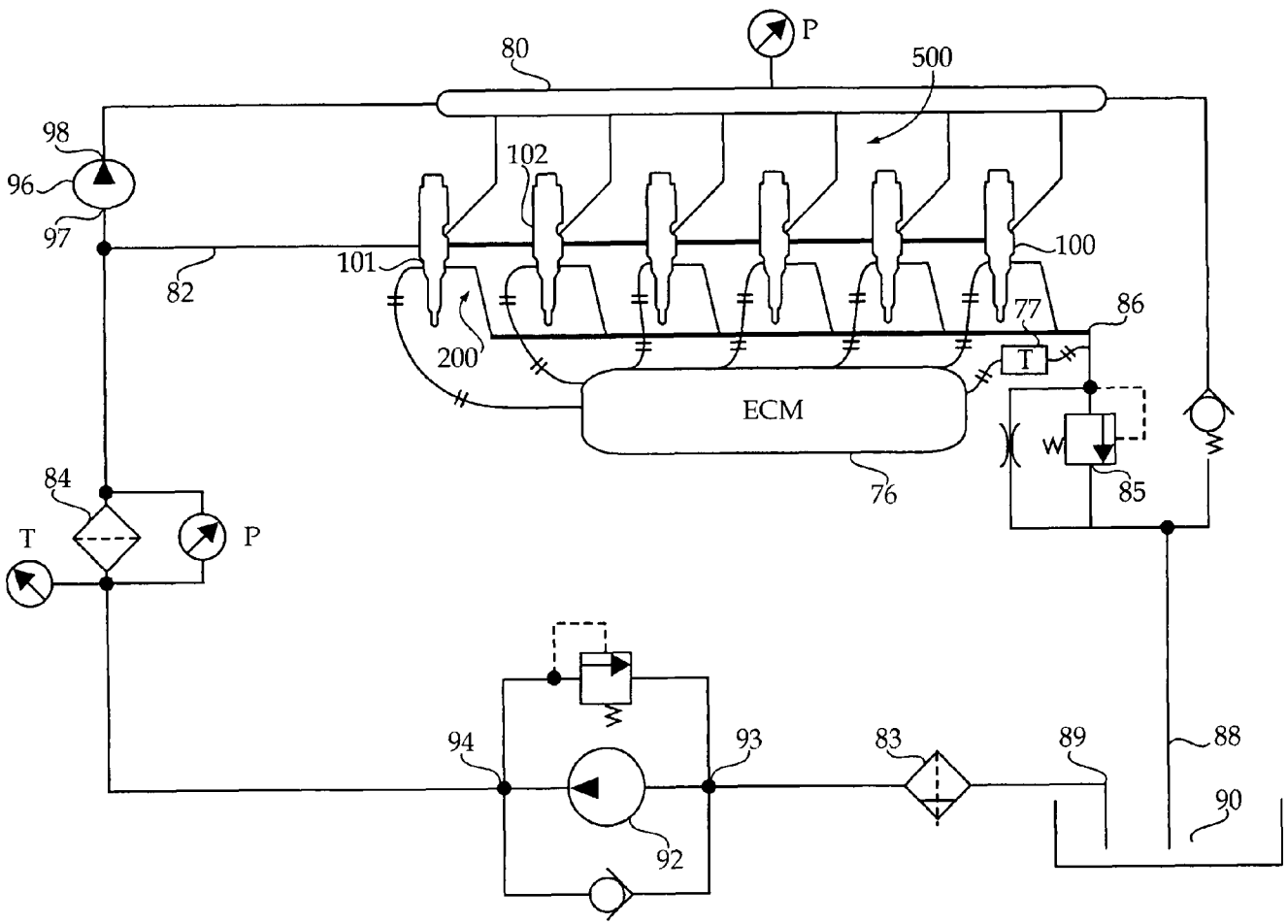
FIG. 3 is a schematic view of a fuel system having a plurality of the fuel injectors as shown in FIG. 1.

Referring also to FIG. 3, a fuel system schematic is shown. A fuel system 500 including a plurality of fuel injectors 200 includes a first injector 101 and a second injector 102 where the first and second fuel injectors 101 and 102 could be any of the plurality of fuel injectors 200. The fuel system 500 further includes a common rail 80 fluidly connected to the common rail inlet port 14 of each of the plurality of identical fuel injectors 200. A cooling line 82 may be fluidly connected to the cooling inlet port 16 of each of the plurality of fuel injectors 200. A fuel return line 72 may fluidly connect the fuel drain port 18 of each of the plurality of fuel injectors 200 to a fuel tank 90.

In a different version of the disclosure, the cooling line 82 may be connected to the first fuel injector 101. The fuel drain port 18 of the first fuel injector 101 may be fluidly connected to the cooling inlet port 18 of the second fuel injector 102. Similarly, in a fuel system 500 with more than two fuel injectors 100, the fuel drain port 18 of a preceding fuel injector may be fluidly connected to the cooling inlet port 16 of the succeeding fuel injector, such that the fuel injectors are sequentially arranged.

The fuel tank 90 has at least one inlet port 88 and at least one outlet port 89. The at least one inlet port 88 is fluidly connected to the fuel return line 86 of the plurality of fuel injectors 200. However, it is conceivable that each fuel injector 100 may be fluidly connected to a respective inlet port 88 of the fuel tank 90. The outlet port 89 of the fuel tank 90 is fluidly connected to an inlet port 93 of a fuel transfer pump 92, which moves fuel from the fuel tank 90 to the cooling line 82 and an inlet port 97 of a common rail pump 96. The common rail pump 96 has an outlet port 98 that is fluidly connected to the common rail 80.

In one embodiment of the disclosure, the fuel system 500 may have a first filter 83 that filters the fuel between the fuel tank 90 and the fuel transfer pump 92 and a second filter 84 that filters the fuel from the fuel transfer pump 92 to the cooling line 82 and common rail 80. In another embodiment, a pressure regulator 85 between the fuel return line 86 and the fuel tank 90 may control the flow of fuel. In another embodiment of the disclosure, an electronic controller 76 may be in communication with a temperature sensor 77 positioned between the plurality of fuel injectors 200 and the fuel tank 90. The electronic controller 76 may execute a cooling control algorithm that has an input signal from the temperature sensor 77 to control the cooling function of the fuel system 500.

Although the embodiments disclosed in the disclosure discuss common rail fuel injectors, it remains within the scope of the disclosure to include other embodiments not limited to common rail fuel injectors or common rail fuel systems. Further, it may be appreciated by those skilled in the art that fuel injectors come in various shapes and forms and different embodiments of a fuel injector should not limit the scope of the disclosure in any way. All fuel injectors having one of a variety of nozzle assemblies, control assemblies and armature assemblies, including those using or not using solenoid actuators lie within the spirit of the present disclosure and are thus within the intended scope of the present disclosure.

INDUSTRIAL APPLICABILITY

The present disclosure finds potential application in fuel injectors and fuel systems in any engine or machine. The present disclosure has a general applicability in fuel injectors having an actuator that generates heat during operation and fuel injectors operating under high pressures, and a particular applicability in common rail fuel injectors.

The present disclosure is directed towards fuel injectors and fuel systems, which include a plurality of fuel injectors. For the sake of clarity, this disclosure will describe a common rail fuel system in terms of one of its solenoid actuated fuel injectors. Further, the present disclosure is not limited to common rail fuel systems but include other fuel systems as well. Similarly, all types of fuel injectors including solenoid actuated, piezoelectric actuated, and cam actuated fuel injectors fall within the scope of this disclosure.

To better understand the cooling feature of the present disclosure, a general understanding of the operation of a fuel injector during an entire injection event is described. Before an injection event, the solenoid coil 25 is in a de-energized state. When the solenoid coil 25 is de-energized, the armature assembly 21 biases the control valve assembly 40 to a first configuration, where the control valve member 44 is at the lower valve seat 57. When the control valve assembly 40 is in the first configuration, the first annular opening 58 establishes a fluid connection between the needle control chamber 72 and the high-pressure nozzle chamber 66 via the rail supply passage 35 and the valve supply passage 33. In this configuration, high-pressure fuel from the common rail inlet port 14 passes through the rail supply passage 35 in to the nozzle chamber 66 and the first annular opening 58 of the control valve assembly 40. Because the control valve member 44 is seated at the lower valve seat 57, a fluid connection between the first annular opening 58 and the valve supply passage 33 is established. Because the valve supply passage 33 is fluidly connected to the needle control chamber 72 via the second flow restrictor 37, high-pressure fuel also passes into the needle control chamber 72 from the valve supply passage 33. Also, high-pressure fuel from the rail supply passage 35 passes into the needle control chamber 72 through the first flow restrictor 36. The high-pressure fuel in the needle control chamber 72 acts on the closing hydraulic surface 70 of the nozzle valve 64. The pressure exerted on the closing hydraulic surface 70 combined with the preload of the nozzle spring 73 is greater than the pressure acting on the opening hydraulic surface 68, thereby biasing the nozzle valve 64 towards the nozzle outlet 62 and keeping the nozzle outlet 62 closed.

When the control valve member 44 is at the lower valve seat 57, there is high pressure inside the nozzle chamber 66, the pressure communication passage 35, the first annular opening 58, the valve supply passage 33, the first and second flow restrictors 36 and 37, and the needle control chamber 72. Because there is high pressure within these passages, the fuel may find its way into lower pressure regions inside the fuel injector 100. For instance, leakage fuel may travel up the guide clearance 50 between the valve guide 52 and the control valve member 44 into the weep annulus 48 and through the weep annulus passage 49 into the cooling clearance 30. The rate at which leakage fuel enters into the cooling clearance is defined as the leakage rate. This rate may be determined by calculating the difference between the rate of flow of fuel entering the cooling inlet port and the rate of flow of fuel leaving the fuel drain port 18. The rate of flow of fuel entering through the cooling inlet port 16 into the fuel injector 100 is defined as the cooling flow rate and is about an order of magnitude greater than the leakage rate of the fuel injector 100. The term about means that when a number is rounded to a like number of significant digits, the numbers are equal. Thus both 0.5 and 1.4 are about equal. The term "order of magnitude greater" means an exponential change of plus 1 in the value of quantity or unit. Therefore, the term "about an order of magnitude greater" means an exponential change of plus 0.5 to plus 1.4 in the value of quantity or unit. Therefore, for instance, if the leakage rate is 1 unit and the cooling rate is about an order of magnitude greater than the leakage rate, the cooling rate could lie anywhere from 3.2 to 25.1 units.

When the leakage fuel flows from a high-pressure region to a low pressure region, some heat is generated. As the rail pressure is increased to higher levels, and the pressure difference increases, more heat is generated and this heat is dissipated along the leakage path. The heat dissipated is transferred to the injector components causing the temperature of the injector components and the leakage fuel to rise.

Independent of whether the solenoid coil 25 is in a de-energized state or an energized state, fuel from a cooling line 82 of the fuel system 500 enters into the fuel injector 100 through the cooling inlet port 16. The fuel that comes from the cooling line 82 is the same fuel that enters the common rail inlet port 14, although it may enter at a lower pressure. The cooling fuel travels from the cooling inlet port 16 through the cooling supply passage 32 into the armature cavity 26. As the pressure of the cooling fuel is greater than the pressure of fuel at the fuel drain port 18, the cooling fuel will travel from the higher-pressure region to the lower pressure region. Further, the armature cavity 26 may be fluidly connected to the solenoid assembly 20 allowing cooling fuel to cool the area around the solenoid coil 25.

The armature cavity 26 may also be fluidly connected to the external surface 42 of the control valve 41 through at least one load screw bore 39 located on the load screw. At least one load screw bore 39 may be drilled through or threaded to allow cooling fuel to enter into contact with the external surface 42 of the control valve 41. Because the control valve assembly 40 is positioned inside the hollow cavity 12 formed by the injector body casing 11, cooling fuel enters into the cooling clearance 30. The cooling fuel flows through the cooling clearance 30, which is fluidly connected to the fuel drain passage 34. There is a portion of the cooling path where the cooling fuel flows through the cooling clearance 30. This portion of the cooling path includes a heat exchange interface with the external surface 42 of the control valve 41. Therefore, there is heat exchange between the cooling fuel and the control valve 41, thereby reducing the temperature of the control valve 41.

In the present disclosure, the weep annulus 48 allows leakage fuel to flow through the weep annulus passage 49 into the cooling clearance 30, where the leakage fuel merges with the cooling fuel. The merged cooling fuel and leakage fuel then flow together into the fuel drain passage and out of the fuel injector 100 through the fuel drain port 18. The amount of fuel leaving the fuel drain port 18 is a combination of the cooling fuel supplied and the leakage fuel.

When the solenoid coil 25 is energized, the armature assembly 21 no longer exerts a force on the control valve assembly 40 and the control valve assembly 40 moves towards a second configuration. The control valve assembly 40 remains in this configuration until the solenoid coil 25 is de-energized again. An injection event begins when the solenoid coil 25 is energized from a de-energized state and ends when the solenoid coil 25 is de-energized from the energized state. Upon energizing the coil 25, the control valve member 44 moves and becomes seated at the high-pressure valve seat 56, blocking the fluid connection passing through the first annular opening 58. Instead, the second annular opening 59 is open and the second annular opening 59 fluidly connects the needle control chamber 72 to the fuel drain passage 34 via the valve supply passage 33. Because the fuel drain passage 34 is at a lower pressure than rail pressure, the pressure difference allows fuel, which was at high pressure inside the needle control chamber 72, to flow through the second flow restrictor 37 and the valve supply passage 33 and into the fuel drain passage 34 via the second annular opening 59. The second flow restrictor 37 has a greater flow rate than the flow rate of the first flow restrictor 36. Therefore, more fuel can leave the needle control chamber 72 via the second flow restrictor 37 than the fuel that can enter the needle control chamber 72 via the first flow restrictor 36. Hence, the pressure inside the needle control chamber 72 becomes lower as more fuel is leaving the needle control chamber 72. As the pressure inside the needle control chamber 72 drops, the pressure acting on the closing hydraulic surface 70 also drops. Eventually, the pressure acting on the opening hydraulic surface 68 exceeds the combined force of the pressure acting on the closing hydraulic surface 70 and the preload of the nozzle spring 73, causing the direct controlled nozzle valve 64 to move away from the nozzle outlet 62. The nozzle outlet 62 is now open and a small amount of fuel moves through the nozzle outlet 62. The amount of fuel that moves through the nozzle outlet 62 is relatively small compared to the relatively large amount of fuel that moves through the fuel drain port 18.

Because the cooling fuel may be entered through the cooling line 82 during and between injection events, there may always be a relatively large amount of fuel leaving the fuel drain port 18. In one embodiment of the present disclosure, the cooling fuel may be controlled to flow through the cooling inlet port 16 when the solenoid coil 25 is de-energized, or in other words, between injection events. Similarly, leakage fuel flows between injection events and may also flow during injection events as well.

In one embodiment of the disclosure, a relatively small amount of fuel may flow through the nozzle outlet 62 during a first injection event and a second injection event. Between the first and second injection events, the nozzle outlet 62 is closed and there is high-pressure fuel inside the fuel injector 100. Inherently, some fuel around the control valve member 44 may begin to leak into the weep annulus 48, and down the weep annulus passage 49 towards the drain port 18. Therefore, in between the first and second injection events, a relatively large amount of fuel as well as leakage fuel may flow through the fuel drain port 18 of the fuel injector 100. Furthermore, it is possible that leakage fuel may move through the guide clearance 50 up to the weep annulus 48 during the first and second injection events and between the first and second injection events. Because there is leakage fuel moving through the guide clearance 50 both during and between the first and second injection events, this leakage fuel along with the cooling fuel, which is a relatively large amount of fuel may flow through the drain port 18, both during and between the first and second injection events.

Referring to the fuel system as shown in FIG. 3, the fuel system 500 includes the fuel tank 90 containing fuel that is supplied to the common rail inlet port 14 and the cooling inlet port 16 of each of the plurality of fuel injectors 200 in the fuel system 500. Fuel from the fuel tank 90 is pumped to the cooling line 82 and inlet port 97 of the common rail fuel pump 96 by the fuel transfer pump 92. The fuel flows through the outlet port 89 of the fuel tank 90 into the inlet port 93 of the fuel transfer pump 92, which may be passively controlled. The fuel flowing from the outlet port 94 of the fuel transfer pump 92 may pass through a series of filters 83 and 84 before entering the plurality of fuel injectors 200, to remove any particles that may affect the performance of the fuel injectors 100. The outlet port 94 of the fuel transfer pump 92 may connect to the cooling line 82 and the inlet port 97 of the common rail pressure pump 96, which may be controlled by the electronic controller 76. The fuel then enters the common rail 80 at rail pressure and flows into each of the fuel injectors 100 through their respective common rail inlet ports 14. Fuel from the cooling line 82 flows into the fuel injectors 100 through their respective cooling inlet ports 16. During each engine cycle, relatively small amounts of fuel are injected through the nozzle outlets 62, while relatively large amounts of fuel leave the fuel drain ports 18 and return to the fuel tank 90 via the fuel return line 86, even if the cooling line 82 is kept closed during injection events. In between injection events, no fuel in injected through the nozzle outlets 62 of the fuel injectors 100, but relatively large amounts of fuel continue to leave the respective fuel drain ports 18 and return to the fuel tank 90 via the fuel return line 86. The pressure regulator 85 may be positioned along the fuel return line 86 to regulate the circulation of flow of the fuel.

Those skilled in the art will appreciate the scope of this disclosure and will realize the scope is not limited to the embodiments described herein. Therefore, changes made to the fuel system and the addition or removal of components that control the flow of the fuel in the fuel system 500 fall within the scope of the present disclosure. For instance, in one embodiment, an engine controller configured to execute a cooling control algorithm may be used. A temperature sensor 77 may be used to provide information to the cooling control algorithm regarding the temperature inside the fuel injectors. If the temperature is higher than a predetermined high-temperature marker, the cooling control algorithm may send a signal to a fuel transfer pump 92 to increase the cooling flow rate into the fuel injectors. Similarly, if the temperature is lower than a predetermined low-temperature marker, the cooling control algorithm may send a signal to the fuel transfer pump 92 to reduce the cooling flow rate of the fuel system 500. In another embodiment, the cooling flow rate may be increased when the engine speed is increased. An electronic controller 76 may control the cooling flow rate by determining the speed of the engine and adjusting the cooling flow rate accordingly. Furthermore, a back-pressure regulator 85 may also regulate the flow of fuel. The cooling line 82 may be supplied at rail pressure or fuel entering the cooling line 82 may flow through a step down pump to reduce the pressure inside the cooling line 82. Further, the fuel drain port 18 of each injector 100 may be fluidly connected to the cooling line 82 or the fuel tank 90 directly. All other embodiments that are within the spirit of the disclosure are intended to fall within the scope of this disclosure.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure, and the appended claims.

What is claimed is:

1. A common rail fuel injector, comprising:

an injector body defining a nozzle outlet, a common rail inlet shaped and positioned for connection to a high pressure common rail, a cooling inlet port and a fuel drain port;

a leakage path fluidly connecting the common rail inlet port to the fuel drain port; and a cooling path fluidly connecting the cooling inlet port to the fuel drain port=and wherein the cooling path remains open when the common rail fuel injector is in an injection configuration and/or a non-injection configuration;

further including a control valve which further includes a valve member slidably disposed within a valve guide; and the leakage path includes a guide clearance defined between an outer surface of the valve member and an inner surface of the valve guide; and an electrical actuator operably coupled to move the valve member between a first position in contact with a seat, and a second position out of contact with the seat.

2. The fuel injector of claim 1, wherein the injector body includes an injector body casing and further including:

a control valve having an external surface enclosed within the injector body casing;

the cooling path includes a heat exchange interface with the external surface of the control valve; and an electrical actuator operably coupled to the control valve.

3. The fuel injector of claim 1, wherein the control valve includes:

a weep annulus positioned on the valve guide; and a weep annulus passage defined within the control valve; and wherein the leakage path includes a heat exchange interface between the weep annulus with the control valve and the weep annulus passage with the control valve.

4. The fuel injector of claim 1 including an armature cavity disposed within an injector body casing, and further including:

a cooling clearance defined between an internal surface of the casing and the external surface of the control valve;

the cooling path includes the armature cavity and the cooling clearance; and an armature of the electrical actuator being attached to move with the valve member within the armature cavity.

5. The fuel injector of claim 4 further includes a direct controlled nozzle valve movable between a first position that closes the nozzle outlet and a second position that opens the nozzle outlet;

the direct controlled nozzle valve includes an opening hydraulic surface exposed to fluid pressure in a nozzle chamber, and a closing hydraulic surface exposed to fluid pressure in a needle control chamber; and the needle control chamber being fluidly connected to the common rail inlet port when in the non-injection configuration and fluidly connected to fuel drain passage by a valve supply passage.

6. A common rail fuel injector for a common rail fuel system in which fuel at high pressure is supplied to the fuel injector for injection into a combustion space, and low pressure fuel is circulated through the fuel injector for cooling the fuel injector due to heat transfer resulting from fuel leakage from an always high pressure area to an always low pressure area, the common rail fuel injector comprising:

an injector body defining a nozzle outlet, a common rail inlet port, shaped and positioned for connection to a high pressure common rail, a cooling inlet port and a fuel drain port;

a leakage path which includes a guide clearance between an outer surface of a valve member and a guide surface of valve body fluidly connecting the common rail inlet port to the fuel drain port;

a cooling path fluidly connecting the cooling inlet port to the fuel drain port.

7. The common rail fuel injector of claim 6, wherein the injector body includes an injector body casing and further including:

a control valve having an external surface enclosed within the injector body casing;

the cooling path includes a heat exchange interface with the external surface of the control valve; and an electrical actuator operably coupled to the control valve.

8. The common rail fuel injector of claim 6 including a control valve which further includes a valve member slidably disposed within a valve guide; and the leakage path includes a guide clearance defined between an outer surface of the valve member and an inner surface of the valve guide; and an electrical actuator operably coupled to move the valve member between a first position in contact with a seat, and a second position out of contact with the seat.

9. The common rail fuel injector of claim 8, wherein the control valve includes:

a weep annulus positioned on the valve guide; and a weep annulus passage defined within the control valve; and wherein the leakage path includes a heat exchange interface between the weep annulus with the control valve and the weep annulus passage with the control valve.

10. The common rail fuel injector of claim 8 including an armature cavity disposed within an injector body casing, and further including:

a cooling clearance defined between an internal surface of the casing and the external surface of the control valve;

the cooling path includes the armature cavity and the cooling clearance; and an armature of the electrical actuator being attached to move with the valve member within the armature cavity.

11. The common rail fuel injector of claim 10 further includes a direct controlled nozzle valve movable between a first position that closes the nozzle outlet and a second position that opens the nozzle outlet;

the direct controlled nozzle valve includes an opening hydraulic surface exposed to fluid pressure in a nozzle chamber, and a closing hydraulic surface exposed to fluid pressure in a needle control chamber; and the needle control chamber being fluidly connected to the common rail inlet port when in the non-injection configuration and fluidly connected to fuel drain passage by a valve supply passage.

12. A common rail fuel injector for a common rail fuel system in which fuel at high pressure is supplied to the fuel injector for injection into a combustion space, and low pressure fuel is circulated through the fuel injector for cooling the fuel injector due to heat transfer resulting from fuel leakage from an always high pressure area to an always low pressure area, the common rail fuel injector comprising:

an injector body defining a nozzle outlet, a common rail inlet port shaped and positioned for connection to a high pressure common rail, a cooling inlet port and a fuel drain port;

a leakage path which includes a guide clearance between a valve member and a valve body fluidly connecting the common rail inlet port to the fuel drain port, wherein fuel in the leakage path generates heat while dropping in pressure from a common rail pressure to a drain pressure;

a cooling path fluidly connecting the cooling inlet port to the fuel drain port, wherein fuel passing through the cooling path absorbs heat generated by fuel in the leakage path; and the leakage path and the cooling path being sized and arranged so that fuel neither enters through the drain port nor exits through the cooling inlet port.

13. The common rail fuel injector of claim 12, wherein the injector body includes an injector body casing and further including:

a control valve having an external surface enclosed within the injector body casing;

the cooling path includes a heat exchange interface with the external surface of the control valve; and wherein the cooling path remains open when the common rail fuel injector is in an injection configuration and/or a non-injection configuration.

14. The common rail fuel injector of claim 12 including a control valve which further includes a valve member slidably disposed within a valve guide; and the leakage path includes a guide clearance defined between an outer surface of the valve member and an inner surface of the valve guide and wherein the cooling path remains open when the common rail fuel injector is in an injection configuration and/or a non-injection configuration.

15. The common rail fuel injector of claim 14, wherein the control valve includes:

a weep annulus positioned on the valve guide; and a weep annulus passage defined within the control valve; and wherein the leakage path includes a heat exchange interface between the weep annulus with the control valve and the weep annulus passage with the control valve.

16. The common rail fuel injector of claim 14 including an armature cavity disposed within an injector body casing, and further including:

a cooling clearance defined between an internal surface of the casing and the external surface of the control valve;

the cooling path includes the armature cavity and the cooling clearance; and an electrical actuator operably coupled to the control valve.

17. The common rail fuel injector of claim 16 further includes a direct controlled nozzle valve movable between a first position that closes the nozzle outlet and a second position that opens the nozzle outlet;

the direct controlled nozzle valve includes an opening hydraulic surface exposed to fluid pressure in a nozzle chamber, and a closing hydraulic surface exposed to fluid pressure in a needle control chamber; and the needle control chamber being fluidly connected to the common rail inlet port when in the non-injection configuration and fluidly connected to fuel drain passage by a valve supply passage.

* * * * *